US008727896B2

(12) United States Patent
Frolov

(10) Patent No.: US 8,727,896 B2
(45) Date of Patent: May 20, 2014

(54) UNDERGROUND AND UNDERWATER AMUSEMENT ATTRACTIONS

(76) Inventor: Anton Frolov, Bell Canyon, CA (US)

( * ) Notice: Subject to any disclaimer, the term of this patent is extended or adjusted under 35 U.S.C. 154(b) by 140 days.

(21) Appl. No.: 13/419,584

(22) Filed: Mar. 14, 2012

(65) Prior Publication Data

US 2013/0244801 A1 Sep. 19, 2013

(51) Int. Cl.
*A63G 31/16* (2006.01)
*A63G 31/00* (2006.01)

(52) U.S. Cl.
USPC ..... 472/60; 472/13; 472/43

(58) Field of Classification Search
USPC ..... 472/43, 59–61, 130, 13; 434/55, 62, 66, 434/69; 104/77, 78, 83, 84, 53, 55, 108
See application file for complete search history.

(56) References Cited

U.S. PATENT DOCUMENTS 5,253,049 A 10/1993 Brooke
5,336,132 A * 8/1994 Murakami ..... 472/59
5,353,074 A 10/1994 Jones et al.
5,403,238 A 4/1995 Baxter et al.
5,669,821 A * 9/1997 Prather et al. ..... 472/60
5,716,281 A * 2/1998 Dote ..... 472/60
6,301,845 B1 * 10/2001 Milanian ..... 52/236.1
6,488,590 B2 * 12/2002 Katayama ..... 472/90
6,796,908 B2 * 9/2004 Weston ..... 472/43
8,079,916 B2 12/2011 Henry

FOREIGN PATENT DOCUMENTS

GB 2332083 A 6/1999
MD 20020175 A 4/2004

* cited by examiner

*Primary Examiner* — Kien Nguyen
(74) *Attorney, Agent, or Firm* — Patent Jurist; Georgiy L. Khayet

(57) ABSTRACT

The attraction systems include underground or underwater tunnels having a visitor transportation system with ride vehicles and multiple audio and video systems for providing an experience of three-dimensional (3D) or four-dimensional (4D) video installations. In addition, the attraction systems may have various special effects devices to enhance visitors' experiences. These underground or underwater tunnels may be built in cities, and especially, in historic city centers.

18 Claims, 8 Drawing Sheets

UNDERGROUND AND UNDERWATER AMUSEMENT ATTRACTIONS

BACKGROUND

1. Technical Field

The present disclosure generally relates to museums and entertainment attractions, and, more specifically, to amusement attractions built in underground or underwater areas.

2. Description of Related Art

The approaches described in this section could be pursued, but are not necessarily approaches that have previously been conceived or pursued. Therefore, unless otherwise indicated, it should not be assumed that any of the approaches described in this section qualify as prior art, merely by virtue of their inclusion in this section.

Amusement parks, theme parks, entertainment attractions, and entertainment rides are widely spread all over the world, and they are currently one of the most popular enjoyments for large number of people. Amusement parks generally include attractions including rides, entertainment venues, playgrounds, recreation spaces, restaurants, and shops that are frequented by park visitors. The number and scope of the attractions and entertainments, however, are widely different and, in general, may be limited by various factors. For example, the space available to build and/or the cost associated with building and maintaining the attractions may limit the number and type of rides in an amusement park. For at least this reason, amusement parks are typically built in suburban areas so they may occupy a large area.

Large cities, especially those having many historic buildings and places located in the city center, may not allow construction of amusement parks and entertainment rides in a city centers. On the other hand, it may be undesirable for many prospective visitors to travel out of city centers to enjoy the experience of attending amusement parks. Thus, there is a need for large cities to provide entertainment attractions in their historic areas (such as city centers) because attractions or amusement parks that include themes associated with the history and development of the city may lead to increase in tourism.

SUMMARY

This summary is provided to introduce a selection of concepts in a simplified form that are further described below in the Detailed Description. This summary is not intended to identify key features or essential features of the claimed subject matter, nor is it intended to be used as an aid in determining the scope of the claimed subject matter.

In accordance with embodiments and the corresponding disclosure thereof, various attraction systems are provided. In general, the disclosed attraction systems may include underground or underwater tunnels having a visitor transportation system with ride vehicles and multiple audio and video systems for providing an experience of three-dimensional (3D) or four-dimensional (4D) video installations. In addition, the attraction systems may have various special effects devices to enhance visitors' experiences. These underground or underwater tunnels may be built in cities, and especially, in historic city centers, which are typically populated with a large number of tourists.

In accordance with one aspect, there is provided an attraction system. The attraction system may comprise a tunnel having a path adapted to be followed throughout the attraction, with the tunnel being at least in part disposed underground or underwater. The attraction system may further comprise at least one image displaying device configured to display images or video along the path at selected locations. The attraction system may comprise a visitor transportation system having at least one ride vehicle, with the visitor transportation system configured to move the at least one ride vehicle along the path.

In one example, the attraction system may further comprise at least one audio means configured to present sounds at selected locations along the path. The attraction system may further comprise scenery positioned along the path at selected locations. The attraction system may further comprise at least one screen for displaying images or video generated by an image displaying device, with the at least one screen positioned at a wall, floor, or ceiling of the tunnel at a selected location. The attraction system may further comprise at least one water spraying device configured to generate a water screen. The at least one image displaying device may comprise a video projection system. The at least one image displaying device may be configured to display a 3D video. The attraction system may further comprise a water channel arranged along the path. The water channel may comprise flowing waters. The at least one ride vehicle may comprise a boat or a raft. The visitor transportation system may comprise at least one rail along the path and an actuating means configured to move the at least one ride vehicle along the path, the at least one ride vehicle being in a rolling contact with the at least one rail. The attraction system may further comprise a control system configured to control motion of the at least one ride vehicle, with the at least one image displaying device based on a position of the at least one ride vehicle or at least one visitor. The control system can be further configured to control at least one audio means based on a position of the at least one ride vehicle or at least one visitor. The attraction system may further comprise a lighting system configured to generate special lighting effects along the path at selected locations. The attraction system may further comprise a plurality of different paths, and the at least one ride vehicle may be configured to follow each of the plurality of different paths alternately. The at least one ride vehicle may comprise a base, at least one passenger seat secured to the base, and wheels in rolling contact with the path. The at least one ride vehicle may further comprise one or more of an audio means for presenting sounds and video displaying means for presenting images or videos. The attraction system may further comprise one or more special effects devices, the special effects devices being configured to generate one or more of a wind, fog, smell, dust cloud, spark, and water spray.

According to another aspect, an attraction system is provided. The attraction system may comprise a tunnel having a path adapted to be followed throughout the attraction. The tunnel can be at least in part disposed underground or underwater. The attraction system may further comprise at least one image displaying device configured to display images or video along the path at selected locations. The attraction system may further comprise at least one travolator configured to move at least one visitor along the path.

According to yet another aspect, a method of providing a ride experience to a visitor in a museum or entertainment park having an attraction system is provided. The attraction system may include a tunnel having a path adapted to be followed. The tunnel can be at least in part disposed underground or underwater. The method may comprise moving the at least one visitor along the path, presenting at least one image or video on one or more screens positioned along the path at selected locations, and presenting sounds along the path at selected locations.

To the accomplishment of the foregoing and related ends, the one or more aspects comprise the features hereinafter fully described and particularly pointed out in the claims. The following description and the drawings set forth in detail certain illustrative features of the one or more aspects. These features are indicative, however, of but a few of the various ways in which the principles of various aspects may be employed, and this description is intended to include all such aspects and their equivalents.

BRIEF DESCRIPTION OF THE DRAWINGS

Embodiments are illustrated by way of example, and not limitation in the figures of the accompanying drawings, in which like references indicate similar elements and in which.

DETAILED DESCRIPTION

Figure 1:
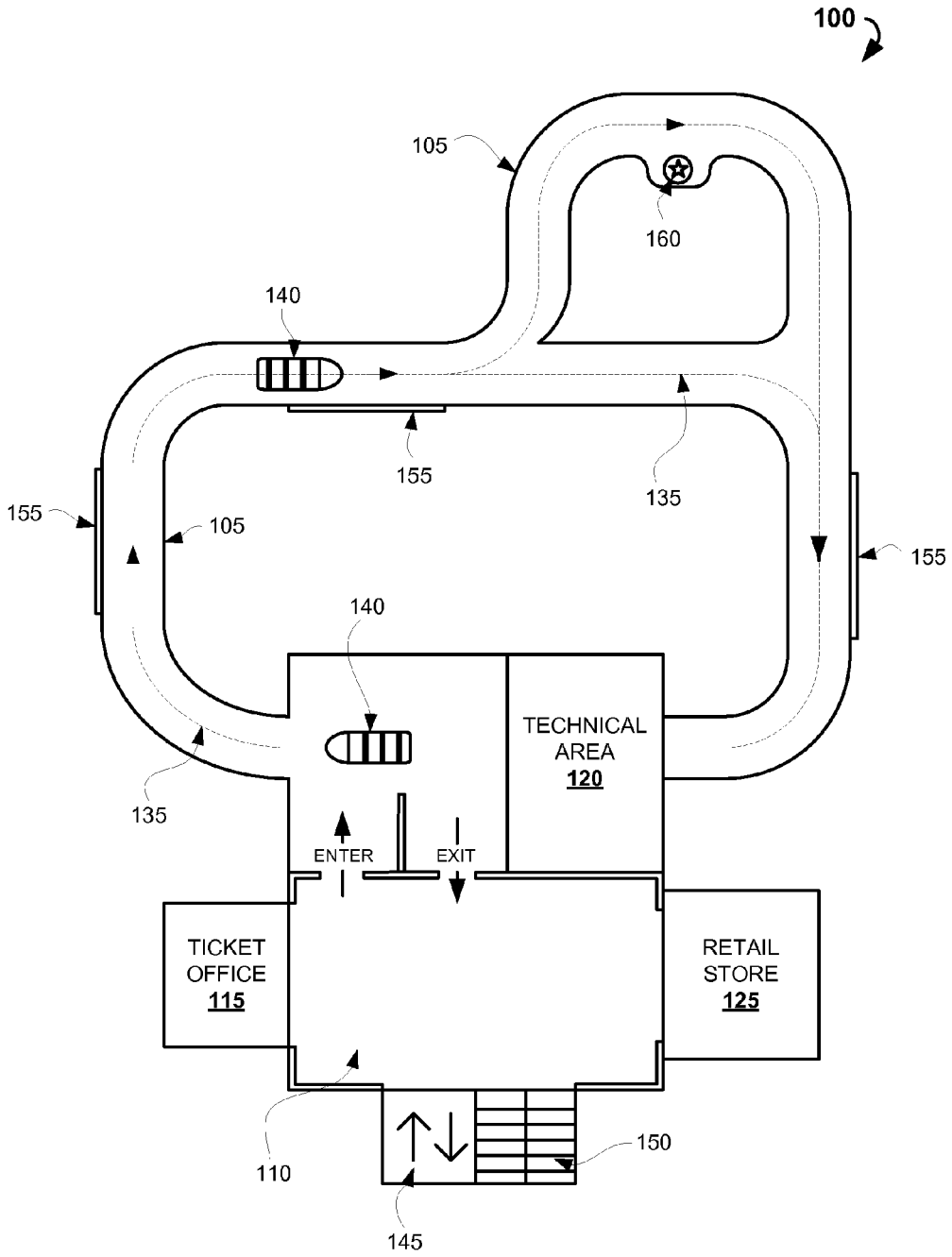
FIG. 1 shows a simplified representation of an amusement system environment.

The following detailed description includes references to the accompanying drawings, which form a part of the detailed description. The drawings show illustrations in accordance with example embodiments. These example embodiments, which are also referred to herein as "examples," are described in enough detail to enable those skilled in the art to practice the present subject matter. The embodiments can be combined, other embodiments can be utilized, or structural, logical, and electrical changes can be made without departing from the scope of what is claimed. The following detailed description is, therefore, not to be taken in a limiting sense, and the scope is defined by the appended claims and their equivalents. In this document, the terms "a" and "an" are used, as is common in patent documents, to include one or more than one. In this document, the term "or" is used to refer to a nonexclusive "or," such that "A or B" includes "A but not B," "B but not A," and "A and B," unless otherwise indicated.

The present disclosure relates to amusement attraction systems and methods for providing a ride experience for visitors of amusement attractions. The amusement attraction systems include one or more tunnels disposed underground and/or underwater. The tunnels may be built underground/underwater either partly or in their entireties. For example, the tunnel may have an entrance above the ground level, but the remaining part can be disposed underground. The tunnels may be either newly built or reconstructed old ones (e.g. renovated drainage tunnels, metro tunnels, etc.). In some additional examples, the tunnels may include basements of buildings, or the tunnels may have entrances located in a basement. It should be also understood that tunnels may have any suitable forms and shapes. For example, the tunnels may be linear, circular, curved, and so forth. The tunnels may have any suitable cross section, including arch, semi-circular, circular, rectangular, and so forth. The materials for tunnel construction may include concrete materials, bricks, concrete blocks, polymer-based materials, or any combination thereof.

The tunnels may have at least one path which can be followed by visitors. For this purpose, visitors may either walk through the tunnel or may use a mechanized system. In an example, the visitors may use personalized vehicles such as electric carts, self-balancing transportation vehicles, and so forth. Alternatively, the visitors may be transported through the paths by a single transportation system. The transportation system, in one example, may include a travolator or series of travolators. According to another embodiment, the transportation system may be configured to move one or more ride vehicles along the paths of the tunnels. In particular, the tunnels may have rails on the floor or attached to the ceiling, and the ride vehicles may be in rolling contact with these rails so that they can be moved along them. The ride vehicles may include individual or shared carts, trolleys, boats, rafts, and so forth. To enable better visitors' experiences, the tunnels may have artificial rivers or pools with flowing and/or still water. Thus, boats or rafts may be propelled through the tunnel by the force of flowing waters and/or actuators of the visitor transportation system.

The tunnels and/or ride vehicles may be equipped with audio-video systems providing various audio- and video experiences for visitors. In particular, two-dimensional (2D) or three-dimensional (3D) images or videos can be displayed on screens along the paths of the tunnels. The screens can be secured to the walls, ceilings, floors, and ride vehicles. The screens may also be implemented as water screens in some embodiments. In addition, it should be mentioned, the screens may have a dedicated shape, for example, a sphere-like shape, and they can be installed in certain rooms or areas within the tunnels. The audio systems may include speakers which can be mounted along the paths in the tunnels, secured to the ride vehicles, or both. In some embodiments, the audio systems may include portable headphones. Both, the audio- and video systems may be triggered to generate images/video and/or sounds when the ride vehicles or visitors reach a certain area or point of the path. For example, the portable headphones or ride vehicles may have, for example, a wireless transmit/receive unit (WTRU) which may receive a triggering command to playback an audio or video message once it is determined that the portable headphone or ride vehicle is in a certain area or point. Those skilled in the art would understand that various and multiple realization of these principles are possible.

As mentioned, the ride vehicles can accommodate passengers and be moved along the tunnels by the action of the visitor transportation system. In some examples, the ride vehicles may be also equipped with actuators enabling motion of the ride vehicle or its part. In result, the passengers may watch 3D images or videos on the tunnel walls or screens when their ride vehicle is moved in one or more directions, thus providing four-dimensional (4D) or five-dimensional (5D) entertainment experience for the passengers. When the screens include semi-sphere or sphere-like screens, the passengers may experience so called "180" or "360" round videos. Thus, one may say the passengers may experience "5D 360" entertainments.

The tunnels may also have scenery, exhibits, and special effects devices (e.g., lighting devices or devices generating a water spray, fog, wind, dust clouds, sparks, smells, and so forth). The scenery and exhibits may also be actuated or moved to provide greater experience for visitors. The amusement attraction systems as described herein can also include general purpose facilities including restrooms, restaurants, retail shops, ticket offices, halls, waiting zones, emergency rooms, elevators, moving staircases, travolators, and so forth.

The described underground/underwater amusement attractions are advantageous for implementation in historic places such as city centers that typically can not accommodate construction of new buildings, nor big amusement attractions, on their terrains. The advantages of underground or underwater construction of amusement attractions within city centers are apparent. In many instances, old and unused drainage or metro tunnels can be used for implementation of described amusement systems. In some examples, unused basements of buildings can be used partly or in their entireties. In addition, the underground/underwater amusement attractions may not only serve for entertaining, but also for education. For example, the underground/underwater amusement attractions may be implemented as a museum (e.g., a historic museum) or an art gallery.

The following description provides the detailed description of various embodiments related to the underground/underwater attraction systems and methods for providing a ride experience to visitors of the underground/underwater attractions.

Referring now to the drawings, FIG. 1 shows a simplified representation of an amusement attraction system environment. In the illustrated example embodiment, the attraction system 100 includes a system of tunnels 105, a number of premises comprising a hall 110, ticket office 115, technical area 120, and retail store 125. The attraction system 100 further includes a visitor transportation system 130, which enables to move ride vehicles along a path 135 within the tunnels 105. The attraction system 100 may further include an elevator 145 and one or more staircases 150, moving staircases, and/or travolators.

Although FIG. 1 shows only two ride vehicles 140, the visitor transportation system 130 may include one or a plurality of them. In some embodiments, however, the visitor transportation system 130 may include one or more travolators (not shown) so that visitors may be moved along the path 135. In addition, although there are depicted two tunnels 105, the attraction system 100 may include one or more tunnels 105, and similarly, the number of all other elements and systems may vary. The tunnels 105 may be circular (as shown) or, alternatively, linear or curved, when the entrance and exit are separated (not shown). The tunnels 105 may have any suitable cross section (e.g., circular, semi-circular, rectangular, etc.) and can be built utilizing any suitable materials including concrete, bricks, concrete blocks, reinforced or armor-clad materials, polymer-based materials, and so forth. The tunnels 105 may be either newly built or renovated (e.g., renovated old drainage tunnels or channels, subway tunnels, etc.). In addition, the tunnels 105 may include at least parts of basements. The attraction system 100 may be entirely disposed in basements or the basements may serve as an entrance/exit to the tunnels 105 only.

The visitor transportation system 130 may include rails and actuators of any type configured to move the one or more ride vehicles 140 through the path 135 on the rails. The visitor transportation system 130 may also partly reside at the technical area 120. In an alternative embodiment, the visitor transportation system 130 may include one or more travolators (not shown). In some additional embodiments, the visitor transportation system 130 may be absent in the attraction system 100. In particular, the visitors may walk through the tunnels 105 or can use personalized vehicles (e.g., electric carts, trolleys, self-balancing transportation vehicles, and so forth).

With continuing reference to FIG. 1, the tunnels 105 may be disposed in underground or underwater areas. In some embodiments, only certain parts of the tunnels 105 can be disposed in an underground or underwater area. For example, an entrance/exit of the tunnels 105 may be located above the ground/water level, while the rest of the tunnel 105 may be located below the ground/water level. The tunnels 105 may either be newly built or old drainage or metro systems that can be used (after some renovation work). It should be apparent that various embodiments are possible for building and disposing the tunnels 105.

Furthermore, the attraction system 100 includes various audio- and video presenting systems that will be described below. In addition, the attraction system 100 may include a lighting system (not shown) to generate various lighting effects, special effects devices (not shown) to generate such effects as water spraying, fog, wind, smells, and the like. The attraction system 100 may also include scenery 155 inside the tunnels 105 and various exhibits 160. Some scenery 155 and/or exhibits 160 may be manipulated and moved by dedicated electro-mechanical systems (not shown).

Accordingly, while the visitors of the attraction system 100 are walking through or moved on their ride vehicles 140 along the path 135 in the underground/underwater tunnels 105, the visitors may be provided with the experience of watching 2D or 3D videos, listening to music and/or narrator speech, and enjoying lighting and other special effects. The displaying of images or videos, presentation of sounds, motion of the ride vehicle 140, and other effects can be controlled by a control system (not shown) in association with the current position of the ride vehicle 140.

Figure 2:
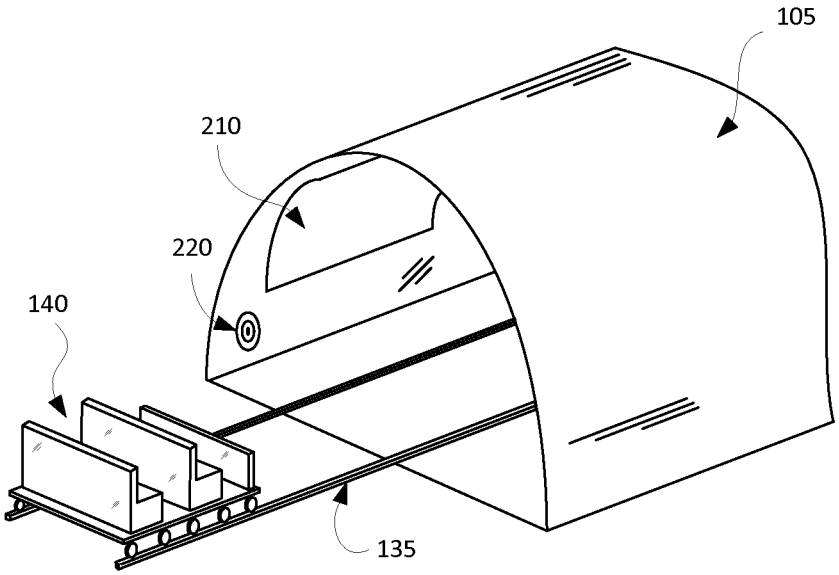
FIG. 2 shows a simplified perspective view of the tunnel.

FIG. 2 shows a simplified perspective view of the tunnel 105. According to the shown embodiment, the tunnel 105 may have a semi-round cross-section, although any other cross section is also applicable. The tunnel 105 includes the path 135 along which the ride vehicles 140 are moved. The path 135, in this example, includes rails, which can be a part of the visitor transportation system 130. The rails can be secured to the floor (as shown) or to the ceiling or walls (not shown). The ride vehicles 140 can be in rolling contact with the rails.

The tunnel 105 may further include one or more screens 210 for displaying images or videos. One example of the screen 210 is shown in FIG. 2. This screen replicates the outer surface of the tunnel 105, although in some embodiments screens 210 may be flat. In yet more embodiments, the walls of the tunnel 105 can be used as a screen. The screen 210 can also be disposed on a ceiling or on a floor. In some additional embodiments, the screen 210 may have sphere-like shape or semi-sphere like shape and can be placed in dedicated rooms or areas within the tunnel 105 or adjoining premises.

In one additional example embodiment, the screens 210 can be implemented as a white surface for displaying projected images and videos. For this purpose, the video displaying devices (not shown) comprise projection systems of any suitable type. However, in some other embodiments, the video displaying devices (not shown) may comprise displays (e.g., LCD displays). In this case, white screens 210 can be substituted by these displays.

In general, the screens 210 are used for displaying 2D or 3D images/videos. The displaying may occur during dedicated or predetermined time periods, or during the time when the visitors are in nearby area. Accordingly, there can be provided various sensors or detectors (not shown) for detecting position of the visitors or ride vehicle 140, and based on the position of the visitors or ride vehicle 140, predetermined images/videos are presented on the screens 210.

With continuing reference to FIG. 2, the tunnel 105 may have speakers 220. The speakers 220 can be a part of the audio means (not shown), which will be described below. In addition to the aforesaid, the tunnel 105 may accommodate various other devices and systems including special effects devices, lighting devices, actuators of the visitor transportation system 130, and so forth.

Figure 3:
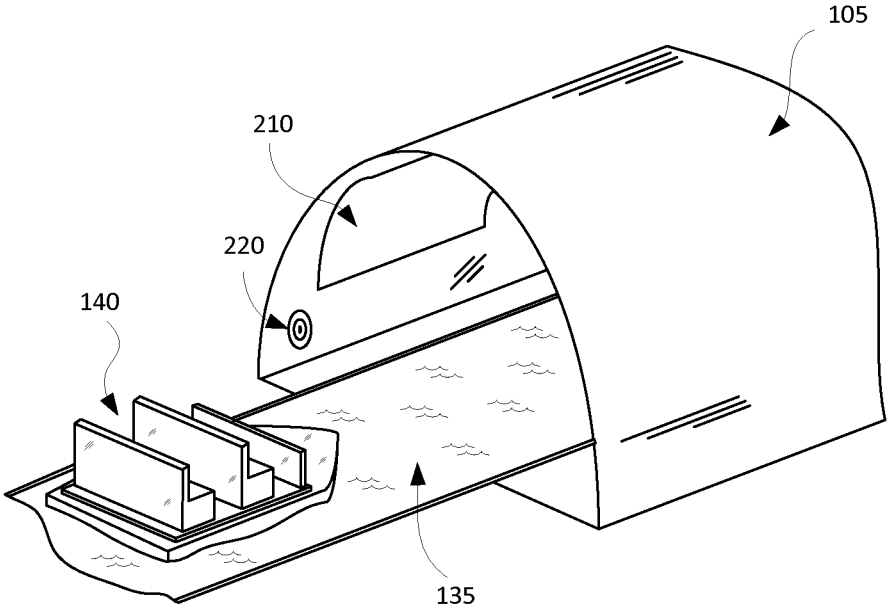
FIG. 3 shows another example of the tunnel.

FIG. 3 shows another example of the tunnel 105. In particular, there is depicted a simplified perspective view of the tunnel 105 having a semi-round cross-section. As shown in the figure, the tunnel 105 includes the path 135 along which the ride vehicles 140 are moved. The path 135 includes a water channel with flowing waters, while the ride vehicle 140 may include a boat or a raft, depending on an application. The ride vehicle may be moved either by the action of flowing waters or by the action of actuators. The actuators may be disposed within the ride vehicle 140 or outside and may be a part of the visitor transportation system 130. Rails can be provided within the water channel (not shown) and can be a part of the visitor transportation system 130 and be used to facilitate movement of the ride vehicles 140.

In yet another embodiment, the water channel may have not flowing waters, but slack waters. In some additional embodiments, the path 135 of the tunnel 105 may be entirely implemented as a water channel, or it may contain just one or more water pools. It should be understood that various embodiments can be used depending on a specific application.

With continuing reference to FIG. 3, the example shown of the tunnel 105 also comprises one or more screens 210 and speakers 220. The screens 210 can be used for displaying 2D or 3D images or videos projected by various video displaying devices. The tunnel 105 may also accommodate various other devices and systems including special effects devices, lighting devices, actuators of the visitor transportation system 130, and so forth.

Figure 4:
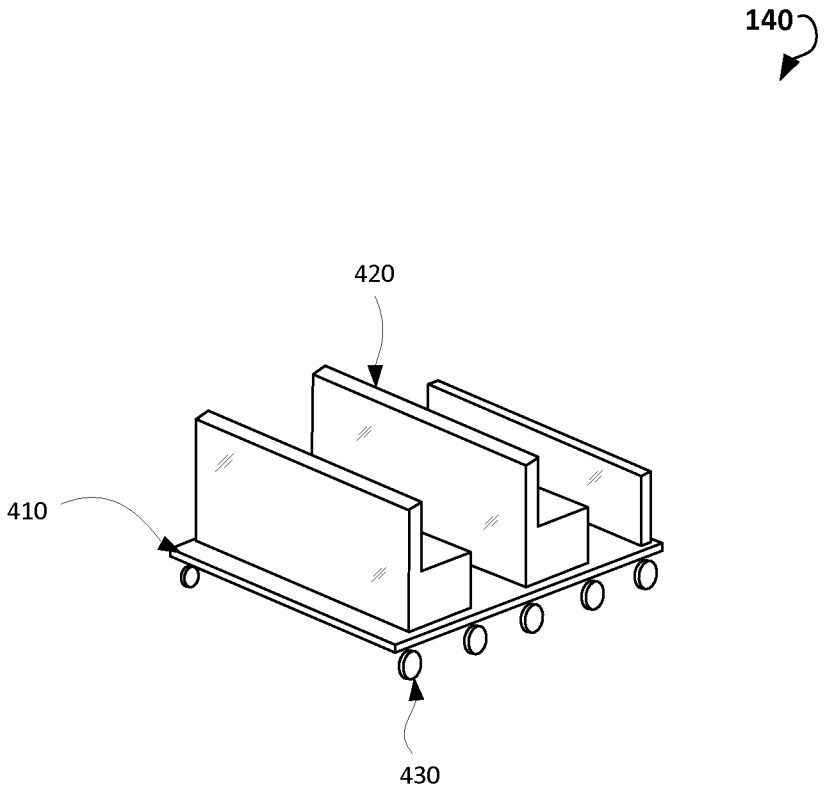
FIG. 4 shows the ride vehicle, according to an example embodiment.

With reference to FIG. 4, the ride vehicle 140 is shown, according to an example embodiment. In this embodiment, the ride vehicle 140 is implemented as a trolley and it includes a base 410, passenger seats 420 secured to the base 410, and wheels 430 in rolling contact with the path 135 (e.g., the rails of the visitor transportation system 130). In some embodiments, the ride vehicle 140 may include actuators or engines configured to move the ride vehicle 140 along the path 135. In addition, the ride vehicle 140 may also have embedded audio and video systems. For example, the ride vehicle 140 may have speakers of audio means for presenting sounds to the visitors. The ride vehicle 140 may also have the video displaying device implemented as a projecting system for projecting images or videos onto the screens 210. The video displaying device may also be implemented as a display (e.g. a LCD or the like) secured to the ride vehicle 140.

Figure 5:
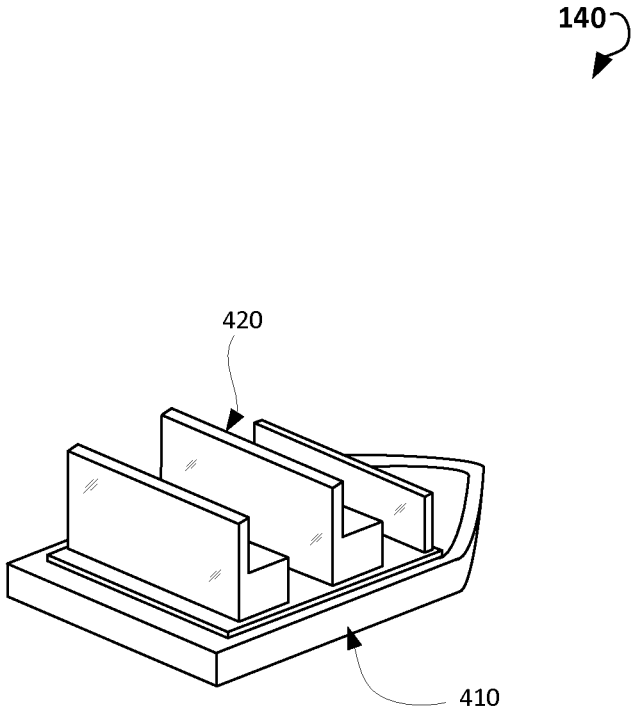
FIG. 5 shows the ride vehicle, according to another example embodiment.

FIG. 5 shows the ride vehicle 140, according to another example embodiment. In the embodiment shown, the ride vehicle 140 is implemented as a boat for the case when the path 135 includes a water channel or an artificial river. Similarly, the ride vehicle 140 includes the base 410 and the passenger seats 420 secured to the base 410. The ride vehicle may also include wheels 430 (not shown) for rolling contact with rails disposed underwater of the path 135 (not shown).

In some additional embodiments, the ride vehicle 140 may include actuators or engines configured to move the ride vehicle 140 along the path 135. The ride vehicle 140 may include audio means, video displaying devices, lighting devices, special effects devices, and the like.

Figure 6:
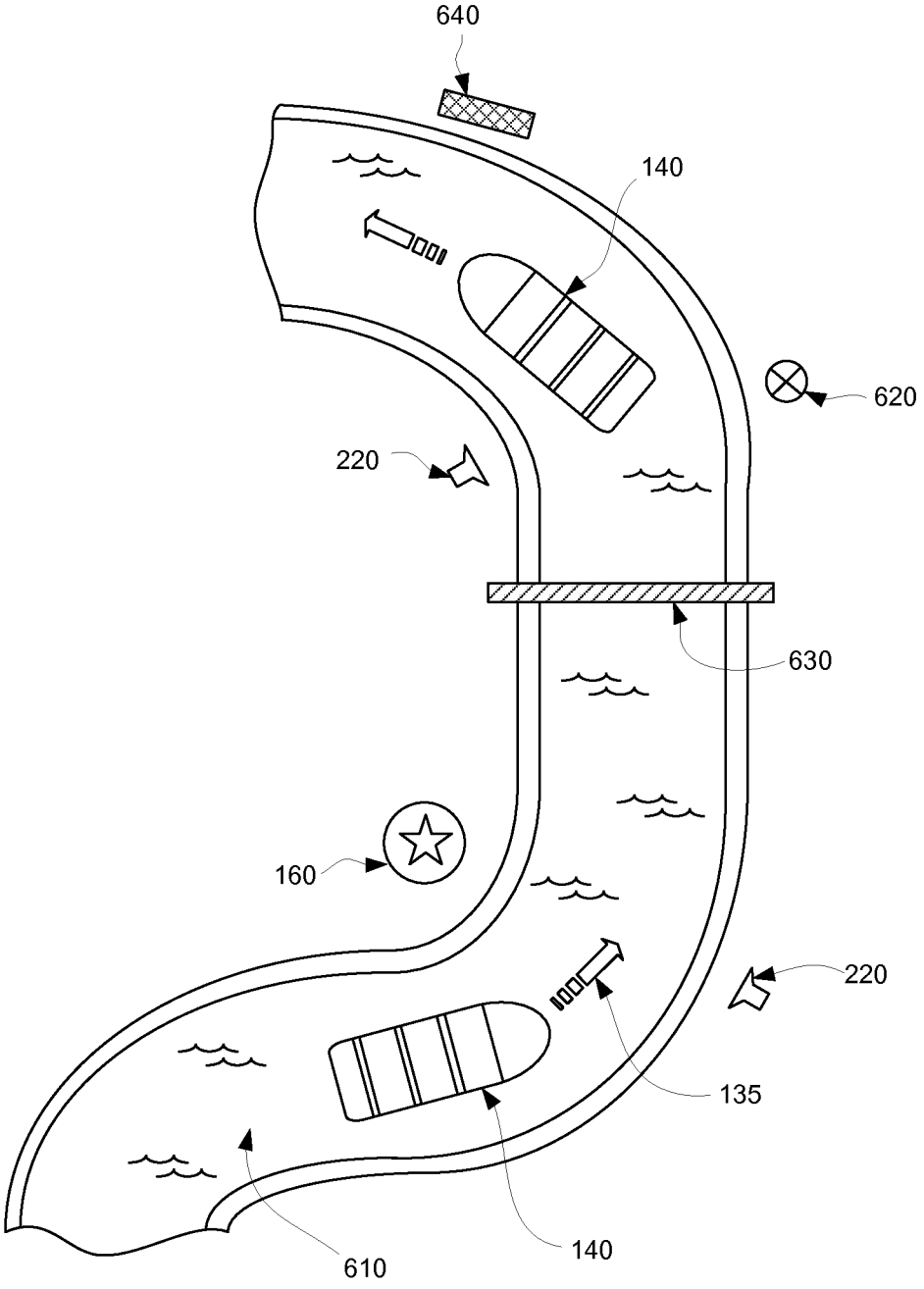
FIG. 6 shows a simplified top view of the tunnel, according to an example embodiment.

With reference now to FIG. 6, there is shown a simplified top view of the tunnel 105, according to an example embodiment. As shown in this figure, the tunnel 105 includes an artificial river 610 having the path 135 to be followed by the ride vehicles 140. The tunnel 105 may be equipped with multiple speakers 220 of audio means for presenting various sounds (e.g., music, narrator speech, sound effects, etc.). In some additional embodiments, the audio means may include personalized and portable audio device with headphones. These portable audio devices may be worn by visitors and these devices may present narrator speech in a particular language. The audio means (wall speakers or portable audio devices) can be actuated based on location of the visitors or in certain time periods. The tunnel 105 may also have lighting devices 620 (e.g., spot lights, flashlights, projectors, stroboscopes, etc.) to generate various special lighting effects.

Furthermore, the tunnel 105 may also include screens 210 (not shown) and video displaying devices (not shown) for presenting 2D or 3D images or videos to the visitors. The screens 210 may be provided along the tunnel 105 at selected locations. In some embodiments, the tunnel 105 may have one or more water screens 630. The water screens 630 may be generated by water spraying devices (not shown) so that the water screen is generated sustainably perpendicular to the path 135 and to the tunnel 105.

With continuing reference to FIG. 6, the tunnel 105 may be also provided with scenery or various exhibits 160. The exhibits 160 may refer to art objects, painting, sculptures, and the like. The scenery or exhibits 160 can be driven by actuators of any kind (not shown). The tunnel 105 may also comprise various special effects devices 640. The special effects devices 640 may generate special effects such as a fog, wind, dust clouds, water spraying, and so forth. In some additional embodiments, the special effects devices 640 may generate certain smells, which can be provided to the visitors at predetermined locations or time periods. All or some of these effects can be generated in particular times or when the visitors are located in a particular points or areas so that the overall visitors' entertaining experience can be enhanced.

Figure 7:
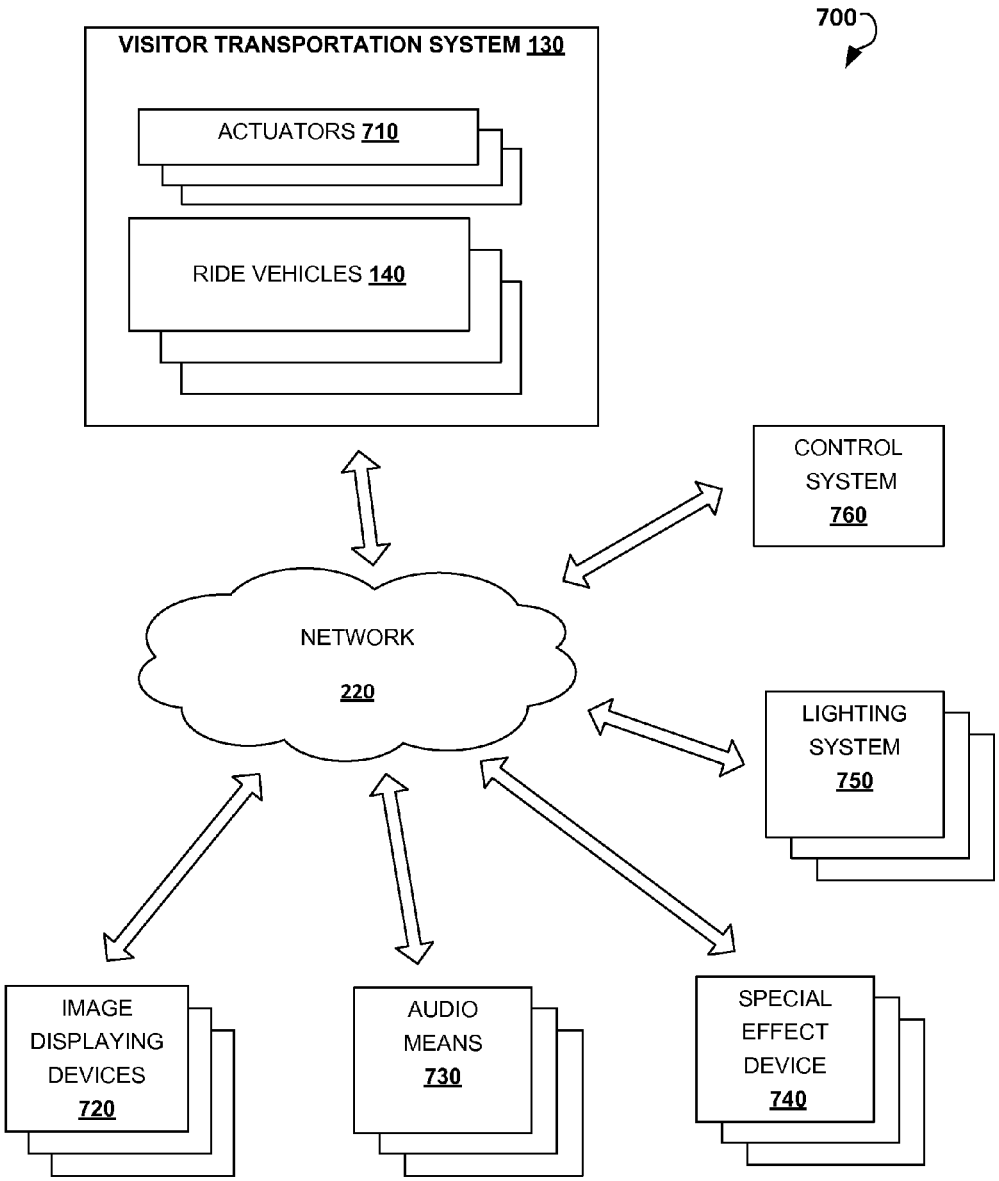
FIG. 7 shows an example overall technical system environment suitable for implementing in the amusement system.

FIG. 7 shows an example overall technical system environment 700 suitable for implementing in attraction system 100. The system environment 700 comprises the visitor transportation system 130, which includes multiple ride vehicles 140 and actuators 710 configured to move the ride vehicles 140 along the path 135 in the tunnels 105. The system environment 700 also comprises one or more image displaying devices 720, one or more audio means 730, one or more special effect devices 740, one or more lighting systems 750, and a control system 760 configured to control all devices and modules of the system environment 700. The controlling may include monitoring of the ride vehicles 140 movements and enabling or disabling certain image displaying devices 720, audio means 730, special effect devices 740, and lighting systems 750 depending on the current position of certain ride vehicles 140 or certain visitors on the path 135.

The control system 760 may also control operation of the visitor transportation system 130. In some embodiments, the control system 760 may also include a terminal (not shown) for enabling a user to monitor and operate any of the described systems and devices. The control system 760 including the terminal may be implemented as a computing system. One example of the computing system includes a processor or multiple processors, a graphics processing unit, a main memory, and a static memory, which communicate with each other via a bus. The computing system can further include a video display unit, and at least one input device, such as an alphanumeric input device, cursor control device, digital camera, video camera, and so forth. The computing system also includes a disk drive unit and network interface device. The disk drive unit may include a computer-readable medium which stores one or more sets of instructions and data structures embodying or utilized by any one or more of the methodologies or functions described herein. The instructions can also reside, completely or at least partially, within the main memory and/or within the processors during execution by the computing system. The main memory and the processors may also constitute a machine-readable media. The term "computer-readable medium" shall also be taken to include any medium that is capable of storing, encoding, or carrying a set of instructions for execution by the machine, and that causes the machine to perform any one or more of the methodologies of the present application, or that is capable of storing, encoding, or carrying data structures utilized by or associated with such a set of instructions. The term "computer-readable medium" shall accordingly be taken to include, but not be limited to, solid-state memories, optical and magnetic media. Such media can also include, without limitation, hard disks, floppy disks, flash memory cards, digital video disks, random access memory (RAM), read only memory (ROM), and the like.

With continuing reference to FIG. 7, the system environment 700 also comprises a network 770 which couples all system components—the visitor transportation system 130, image displaying devices 720, one or more audio means 730, one or more special effect devices 740, one or more lighting systems 750, and control system 760. The network 770 is a network of data processing nodes interconnected for the purpose of data communication, which may be utilized to communicatively couple various components of the system environment 700. The network 770 may include the Internet or any other network capable of communicating data between devices. Suitable networks may include or interface with any one or more of the following: local intranet, PAN (Personal Area Network), LAN (Local Area Network), WAN (Wide Area Network), MAN (Metropolitan Area Network), Ethernet connection, and ISDN (Integrated Services Digital Network) line. Furthermore, communications may also include links to any of a variety of wireless networks including: WAP (Wireless Application Protocol), GPRS (General Packet Radio Service), GSM (Global System for Mobile Communication), CDMA (Code Division Multiple Access) or TDMA (Time Division Multiple Access), cellular phone networks, GPS, CDPD (cellular digital packet data), RIM (Research in Motion, Limited) duplex paging network, Bluetooth radio, or an IEEE 802.11-based radio frequency network. The network 770 can further include or interface with any one or more of the following: RS-232 serial connection, IEEE-1394 (Firewire) connection, Fiber Channel connection, IrDA (infrared) port, SCSI (Small Computer Systems Interface) connection, USB (Universal Serial Bus) connection, or other wired or wireless, digital or analog interface or connection, mesh or Digi® networking.

Figure 8:
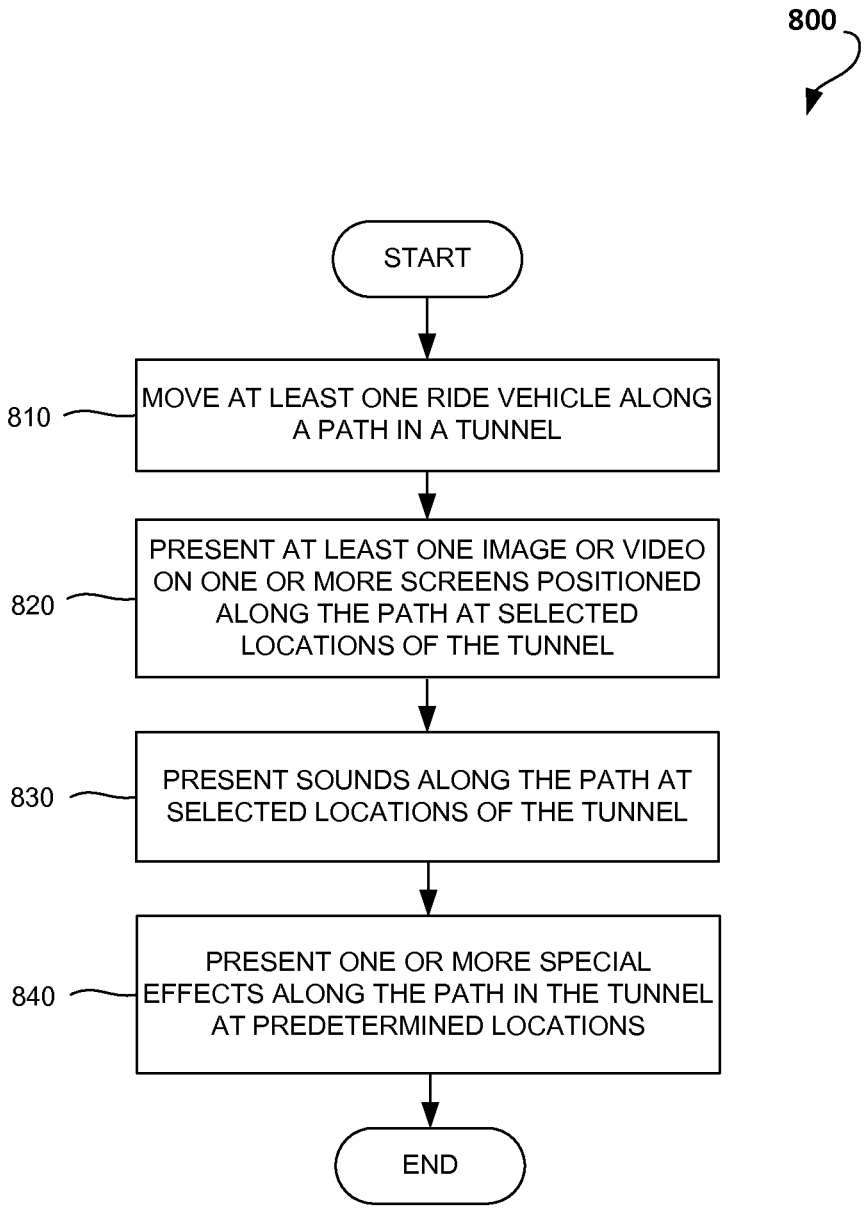
FIG. 8 is a process flow diagram showing a method for providing a ride experience to a visitor in a museum or entertainment park having an attraction system.

FIG. 8 is a process flow diagram showing a method 800 for providing a ride experience to a visitor in a museum or entertainment park having the attraction system 100. The method 800 may be performed by processing logic that may comprise hardware (e.g., dedicated logic, programmable logic, and microcode), software (such as software run on a general-purpose computer system or a dedicated machine), or a combination of both. In one example embodiment, the processing logic resides at the control system 760.

As shown in FIG. 8, the method 800 may commence at operation 810, with the visitor transportation system 130 moving the at least one ride vehicle 140 along the path 135 in the tunnel 105. The ride vehicles 140 can be moved by the action of various and multiple actuators which can be disposed in ride vehicles 140, outside, or in combination with each other. In some embodiments, the motion of the ride vehicles is controlled by the control system 760 with the help of various sensors or detectors.

At operation 820, the one or more image displaying devices 720 present at least one image or video on one or more screens 210 positioned along the path 135 at selected locations. The images or videos can be either projected onto the screens 210 or can be displayed by various image devices such as LCD or the like. In addition, the images or videos can be presented to the visitors depending on their location or movement. For example, when visitors come to a certain area, this can be determined by motion sensors, volume change sensors or the like, and this may trigger video system for displaying dedicated images/videos at the screens 210. The triggering signal may also be generated by the control system 760.

At operation 830, the one or more audio means 730 present sounds along the path 135 at selected locations of the tunnel 105. The audio means 730 may include various speakers disposed in the tunnel or in the ride vehicles 140 or in portable audio devices wearable by the visitors. At this operation, sounds can be presented to the visitors depending on a location of the visitors (e.g., a dedicated message can be played back once a visitor comes into proximity with an art object).

At operation 840, the one or more special effect devices 740 and the lighting system 750 present one or more special effects along the path 135 in the tunnel 105 at predetermined locations. Similarly, the special effect devices 740 and the lighting systems 750 may be actuated by a triggering signal obtained from various sensors or the control system 760. The special effects can be presented in certain time periods, and, for example, in association with the presented video or sounds.

Thus, attraction systems and methods for providing a ride experience to visitors in a museum or entertainment park having the attraction system have been described. Although embodiments have been described with reference to specific example embodiments, it will be evident that various modifications and changes can be made to these example embodiments without departing from the broader spirit and scope of the present application. Accordingly, the specification and drawings are to be regarded in an illustrative rather than a restrictive sense.

What is claimed is:

1. An attraction system, comprising:

a tunnel having a path adapted to be followed throughout the attraction, the tunnel being at least in part disposed underground or underwater;

at least one image displaying device secured inside the tunnel and configured to display images or video along the path at selected locations on one or more screens, wherein the one or more screens are positioned at one or more of a wall, a floor, or a ceiling of the tunnel;

a visitor transportation system having at least one ride vehicle, the visitor transportation system configured to move the at least one ride vehicle along the path inside the tunnel;

a lighting system configured to generate special lighting effects along the path at selected locations inside the tunnel based on a location of at least one visitor inside the tunnel; and wherein the images or video are displayed based on the location of the at least one visitor inside the tunnel.

2. The attraction system of claim 1, further comprising at least one audio means configured to present sounds at selected locations along the path, wherein at least one audio means is arranged inside the tunnel.

3. The attraction system of claim 1, further comprising scenery positioned along the path at selected locations inside the tunnel.

4. The attraction system of claim 1, further comprising at least one water spraying device configured to generate a water screen.

5. The attraction system of claim 1, wherein the at least one image displaying device comprises a video projection system.

6. The attraction system of claim 1, wherein the at least one image displaying device is configured to display a three-dimensional (3D) video.

7. The attraction system of claim 1, wherein a water channel arranged along the path inside the tunnel.

8. The attraction system of claim 7, wherein the water channel comprises flowing waters.

9. The attraction system of claim 7, wherein the at least one ride vehicle comprises a boat or a raft.

10. The attraction system of claim 1, wherein the visitor transportation system comprises at least one rail along the path and actuating means configured to move the at least one ride vehicle along the path, the at least one ride vehicle being in a rolling contact with the at least one rail.

11. The attraction system of claim 1, further comprising a control system configured to control motion of the at least one ride vehicle, with the at least one image displaying device based on a position of the at least one ride vehicle or the at least one visitor.

12. The attraction system of claim 11, wherein the control system is further configured to control at least one audio means based on a position of the at least one ride vehicle or the at least one visitor.

13. The attraction system of claim 1, further comprising a plurality of different paths; and the at least one ride vehicle is configured to follow each of the plurality of different paths alternately.

14. The attraction system of claim 1, wherein the at least one ride vehicle comprises a base, at least one passenger seat secured to the base, and wheels in rolling contact with the path.

15. The attraction system of claim 14, wherein the at least one ride vehicle further comprises one or more of an audio means for presenting sounds and video displaying means for presenting images or videos.

16. The attraction system of claim 1, further comprising one or more special effects devices, the special effects devices being configured to generate one or more of a wind, fog, smell, dust cloud, spark, and water spray.

17. An attraction system, comprising:

a tunnel having a path adapted to be followed throughout the attraction, the tunnel being at least in part disposed underground or underwater;

at least one image displaying device secured inside the tunnel and configured to display images or video along the path at selected locations on one or more screens; wherein the one or more screens positioned at a wall, floor, or ceiling of the tunnel;

at least one travolator configured to move at least one visitor along the path inside the tunnel;

a lighting system configured to generate special lighting effects along the path at selected locations inside the tunnel based on a location of at least one visitor inside the tunnel; and wherein the images or video are displayed based on the location of the at least one visitor inside the tunnel.

18. A method of providing a ride experience to at least one visitor in a museum or entertainment park having an attraction system, the attraction system including a tunnel having a path adapted to be followed, the tunnel being at least in part disposed underground or underwater, the method comprising:

moving the at least one visitor along the path inside the tunnel;

presenting at least one image or video on one or more screens positioned along the path at selected locations inside the tunnel depending on a current location of the at least one visitor;

generating special lighting effects along the path at selected locations inside the tunnel depending on the current location of the at least one visitor; and presenting sounds along the path at selected locations inside the tunnel depending on a current location of the at least one visitor.

* * * * *